US011159892B2

(12) United States Patent
Huang et al.

(10) Patent No.: US 11,159,892 B2
(45) Date of Patent: Oct. 26, 2021

(54) SOUNDING DEVICE AND MOBILE TERMINAL

(71) Applicant: AAC Technologies Pte. Ltd., Singapore (SG)

(72) Inventors: Xingzhi Huang, Shenzhen (CN); Lin Liu, Shenzhen (CN); Dijiang Tong, Shenzhen (CN); Zhe Zhang, Shenzhen (CN); Jun Wu, Shenzhen (CN); Zhichen Chen, Shenzhen (CN); Zhaoyu Yin, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 0 days.

(21) Appl. No.: 16/995,846

(22) Filed: Aug. 18, 2020

(65) Prior Publication Data

US 2021/0029467 A1 Jan. 28, 2021

Related U.S. Application Data

(63) Continuation of application No. PCT/CN2019/098149, filed on Jul. 29, 2019.

(30) Foreign Application Priority Data

Jul. 23, 2019 (CN) ..... 201910668245.4

(51) Int. Cl.

| | |
|---|---|
| ***H04R 9/06*** | (2006.01) |
| ***H04R 9/02*** | (2006.01) |
| ***H04R 1/02*** | (2006.01) |
| ***H04R 1/28*** | (2006.01) |

(52) U.S. Cl.

CPC ..... *H04R 9/06* (2013.01); *H04R 1/021* (2013.01); *H04R 1/023* (2013.01); *H04R 1/2834* (2013.01); *H04R 9/02* (2013.01); *H04R 2400/11* (2013.01); *H04R 2499/11* (2013.01)

(58) Field of Classification Search

CPC ..... H04R 1/021; H04R 1/023; H04R 1/026; H04R 1/2811; H04R 1/2823; H04R 1/2826; H04R 1/2834; H04R 1/2849; H04R 9/02; H04R 9/06; H04R 2400/11; H04R 2499/11

See application file for complete search history.

(56) References Cited

U.S. PATENT DOCUMENTS

| | | | | |
|---|---|---|---|---|
| 9,024,396 | B2 * | 5/2015 | Dehe | B81B 3/0094 257/416 |
| 2018/0020283 | A1 * | 1/2018 | Zhang | F16K 25/005 |
| 2021/0051816 | A1 * | 2/2021 | Huang | G06F 1/203 |
| 2021/0112342 | A1 * | 4/2021 | Xu | H04R 1/025 |

* cited by examiner

*Primary Examiner* — Huyen D Le
(74) *Attorney, Agent, or Firm* — W&G Law Group

(57) ABSTRACT

The invention relates to a sounding device having a first housing body with a first accommodation space, and a speaker box accommodated into the first housing body. The speaker box includes a second housing body with a second accommodation space, and a speaker unit accommodated in the second housing body. The speaker unit divides the second accommodation space into a front acoustic cavity. The sounding device further comprises a one-way intake valve. The speaker box, serving as a fan in a mobile terminal, pushes air circulation inside and outside the mobile terminal, thereby achieving a heat dissipation effect and facilitating internal cooling of the mobile terminal.

14 Claims, 5 Drawing Sheets

SOUNDING DEVICE AND MOBILE TERMINAL

FIELD OF THE PRESENT DISCLOSURE

The invention relates to technical field of heat dissipation technology, in particular to a sounding device and a mobile terminal with heat dissipation function.

DESCRIPTION OF RELATED ART

With the advent of the mobile Internet era, the number of smart mobile terminals is increasing continuously. Among many mobile terminals, mobile phone is undoubtedly the most common and portable mobile terminal. At present, a mobile phone has a diversity of functions, one is a high-quality music function, and therefore, a sounding device for broadcasting sound is massively applied to current intelligent mobile terminals.

In the related art, a mobile terminal is small in internal space, and a great number of heat source components, such as CPUs and batteries, are integrated in the mobile terminal, therefore, a great deal of heat can be generated after long-term operation of the mobile terminal, and the problem of heat radiation becomes a main technical difficulty which restricts development of mobile terminals.

SUMMARY OF THE INVENTION

One of the objects of the invention is to provide a sounding device with improved heat dissipation performance.

Accordingly, the invention discloses a sounding device, comprising:

a housing body with a first accommodation space;

a speaker box accommodated in the first housing body, comprising a second housing body with a second accommodation space;

a speaker unit accommodated in the second housing body, comprising a diaphragm dividing the second accommodation space into a front acoustic cavity positioned between the diaphragm and the second housing body;

the second housing body comprising a sound channel communicating the front acoustic cavity and an external environment of the speaker box, and a cover plate part arranged directly opposite to the diaphragm;

the front acoustic cavity positioned between the diaphragm and the cover plate part;

the cover plate part comprising a through opening communicating the front acoustic cavity and the first accommodation space;

wherein the sounding device further includes a one-way intake valve arranged corresponding to the through opening for introducing air in the first accommodation space into the front acoustic cavity;

the one-way intake valve comprises a flexible film of which one end is fixedly arranged on the surface of one side, toward the diaphragm, of the cover plate part and completely covers the through opening, a reinforcement part fixedly arranged on the flexible film, and an elastic body of which one end is fixed on the reinforcement part and the other end is fixed on the first housing body;

the flexible film comprises a fixation part fixed to the cover plate part and a free end part capable of moving up and down relative to the cover plate part to form an air inlet gap between the flexible film and the cover plate part; and the elastic body is arranged close to the free end part.

Further, the flexible film further comprises a deformation part connecting the free end part and the fixation part; the deformation part is positioned between the fixation part and the cover plate part; the one-way intake valve further comprises a reinforcement body fixedly arranged on the circumference of the flexible film and the surface of one side far away from the cover plate part; the reinforcement body comprises spaced first reinforcement body and second reinforcement bodies; the first reinforcement body and the second reinforcement bodies are spaced from one another to form an avoidance part; and the avoidance part corresponds to the deformation part.

Further, the flexible film is spaced from the cover plate part.

Further, the flexible film is in a rectangular form; and the fixation part and the free end part extend along a short axis direction of the flexible film.

Further, the elastic body is in a hollow cylindrical form.

Further, the through opening and the reinforcement part both are in a rectangular form matched with the shape of the flexible film.

Further, the first reinforcement body is in an elongated form and is arranged corresponding to the fixation part; three second reinforcement bodies are arranged; each second reinforcement body is arranged corresponding to the other three edges of the flexible film; and the three second reinforcement bodies are formed as a whole.

The sounding device, further comprises a one-way air outlet valve arranged in the sound channel, wherein the one-way air outlet valve is used for discharging the air in the front acoustic cavity into the external environment of the speaker box through the sound channel.

Further, the first housing body comprises an air inlet communicating the external environment and the first accommodation space, and an air outlet communicating with the sound channel; the one-way intake valve connects the first accommodation space and the front acoustic cavity; and the one-way air outlet valve connects the sound channel and the air outlet.

The present invention further provides a mobile terminal, comprising a sounding device as described above.

BRIEF DESCRIPTION OF THE DRAWINGS

Many aspects of the exemplary embodiment can be better understood with reference to the following drawings. The components in the drawing are not necessarily drawn to scale, the emphasis instead being placed upon clearly illustrating the principles of the present disclosure.

DETAILED DESCRIPTION OF THE EXEMPLARY EMBODIMENTS

The present disclosure will hereinafter be described in detail with reference to an exemplary embodiment. To make the technical problems to be solved, technical solutions and beneficial effects of the present disclosure more apparent, the present disclosure is described in further detail together with the figure and the embodiment. It should be understood the specific embodiment described hereby is only to explain the disclosure, not intended to limit the disclosure.

Figure 1:
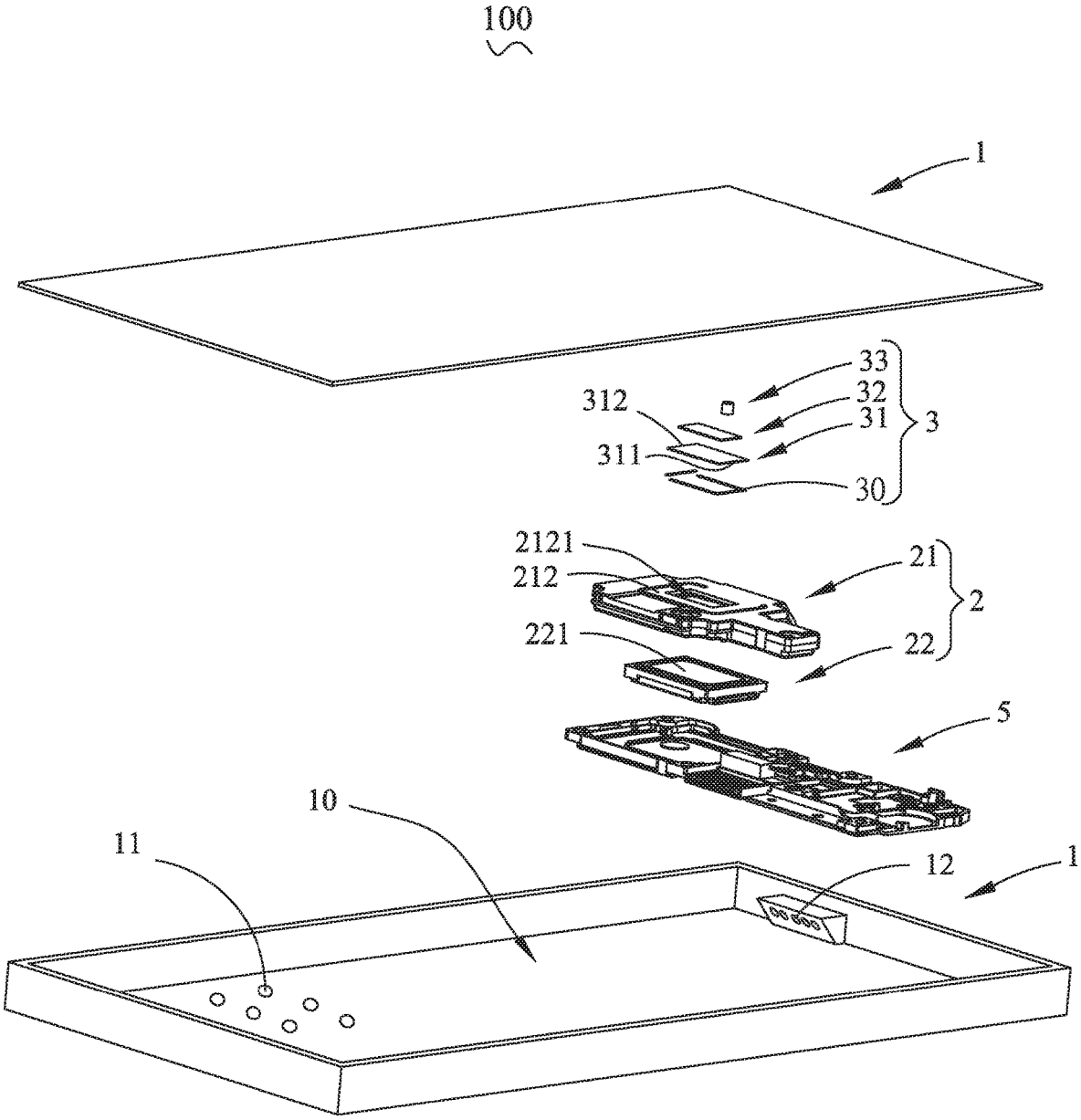
FIG. 1 is an isometric view of a sounding device of an embodiment of the invention.
Figure 2:
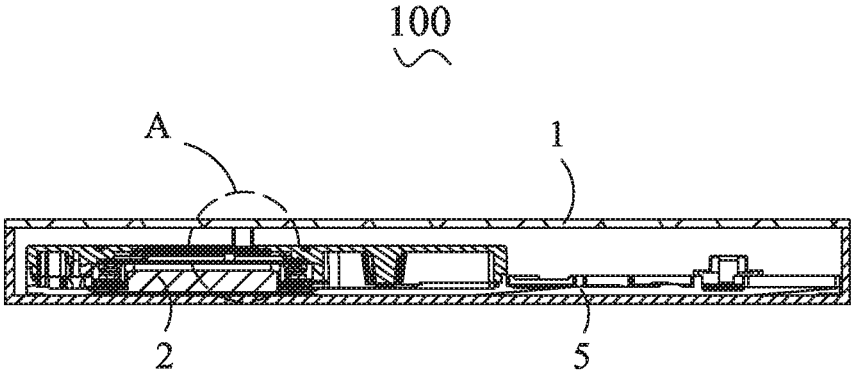
FIG. 2 is a cross-sectional view along a short axis direction of the sounding device of the invention.
Figure 3:
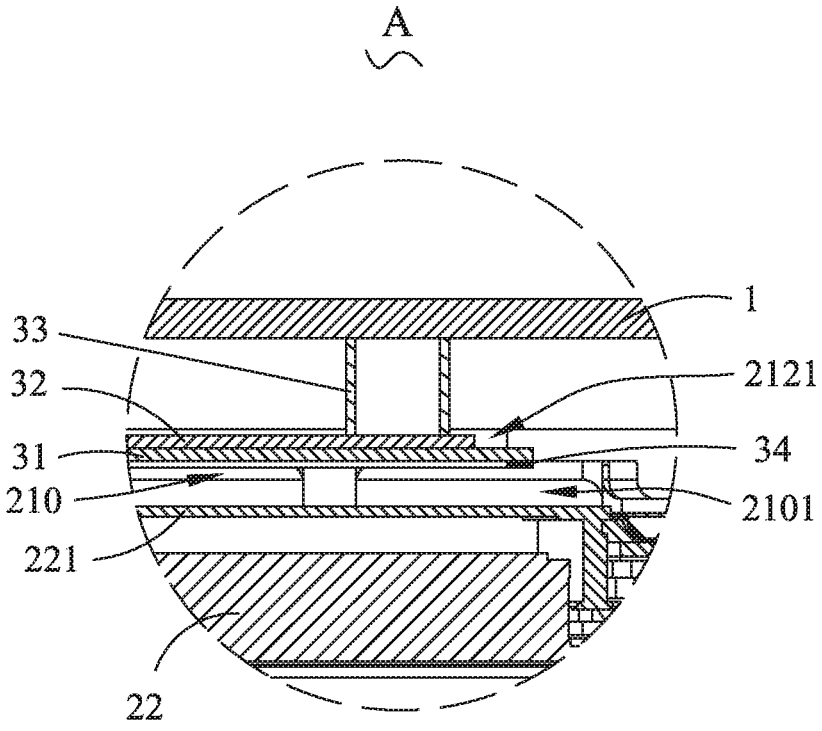
FIG. 3 is an enlarged view of part A in FIG. 2.

Referring to FIGS. 1-3, the invention provides a sounding device 100, which comprises a first housing body 1 with a first accommodation space 10, and a speaker box 2 accommodated into the first housing body 1 and used for sounding. The first housing body 1 comprises an air inlet 11 and an air outlet 12; cold air enters the first accommodation space 10 in the first housing body 1 from the air inlet 11, and then the air is pushed to be discharged from the air outlet 12 through up-and-down vibration of a diaphragm in the speaker box 2, so that the speaker box 2 pushes air circulation inside and outside the first housing body 1 to achieve a heat dissipation effect.

Specifically, the speaker box 2 comprises a second housing body 21 with a second accommodation space 210, and a speaker unit 22 accommodated into the second housing body 21. The speaker unit 22 comprises the diaphragm 221 used for sounding through vibration. The diaphragm 221 divides the second accommodation space 210 into a front acoustic cavity 2101 positioned between the diaphragm 221 and the second housing body 21. The second housing body 21 comprises a sound channel 211 communicating the front acoustic cavity 2101 and an external environment of the speaker box 2, and a cover plate part 212 arranged directly opposite to the diaphragm 221. The front acoustic cavity 2101 is positioned between the diaphragm 221 and the cover plate part 212. The cover plate part 212 comprises a through opening 2121 communicating the front acoustic cavity 2101 and the external environment. The sounding device 100 further comprises a one-way intake valve 3 arranged corresponding to the through opening 2121 and a one-way air outlet valve 4 arranged in the sound channel 211.

Figure 4:
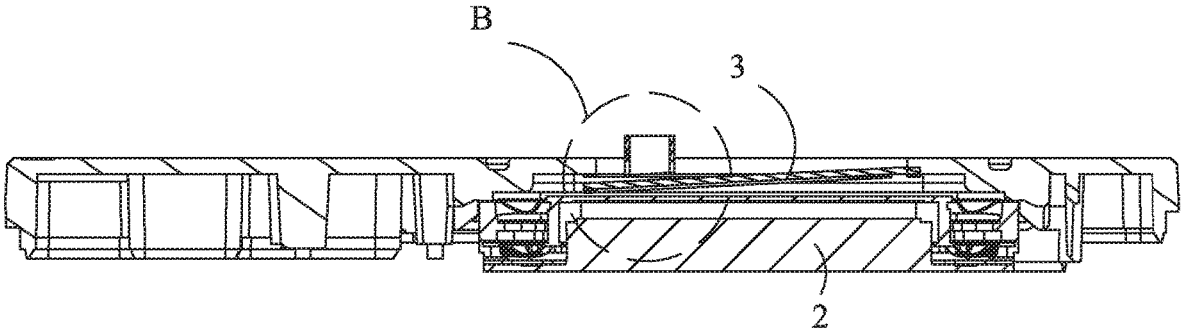
FIG. 4 shows a state of a one-way intake valve and a speaker box during intake.

Referring to FIGS. 4-5 again, the one-way intake valve 3 is used for introducing the air in the external environment of the speaker box 100 into the front acoustic cavity 2101. The one-way air outlet valve 4 is used for discharging the air in the front acoustic cavity 2101 into the external environment of the speaker box 100 through the sound channel 211.

Figure 5:
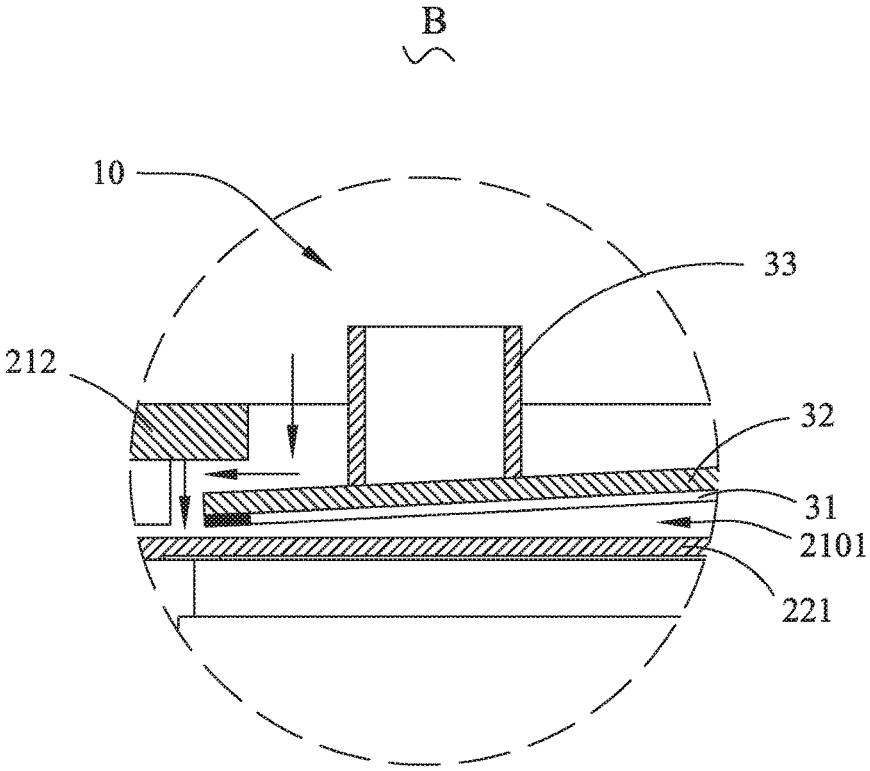
FIG. 5 is an enlarged view of part B in FIG. 4.

Specifically, when the diaphragm 221 vibrates downward, the air in the first accommodation space 10 is drawn into the front acoustic cavity 2101, specifically referring to FIG. 5, in this, arrowheads indicate the flow direction of the air; when the diaphragm 221 vibrates upward, the air in the front acoustic cavity 2101 is discharged outside the first housing body 1 from the one-way air outlet valve 4. That is to say, the speaker unit 22 has a function of a fan and pushes air circulation inside and outside the first housing body 1, so as to achieve the heat dissipation effect.

Figure 6:
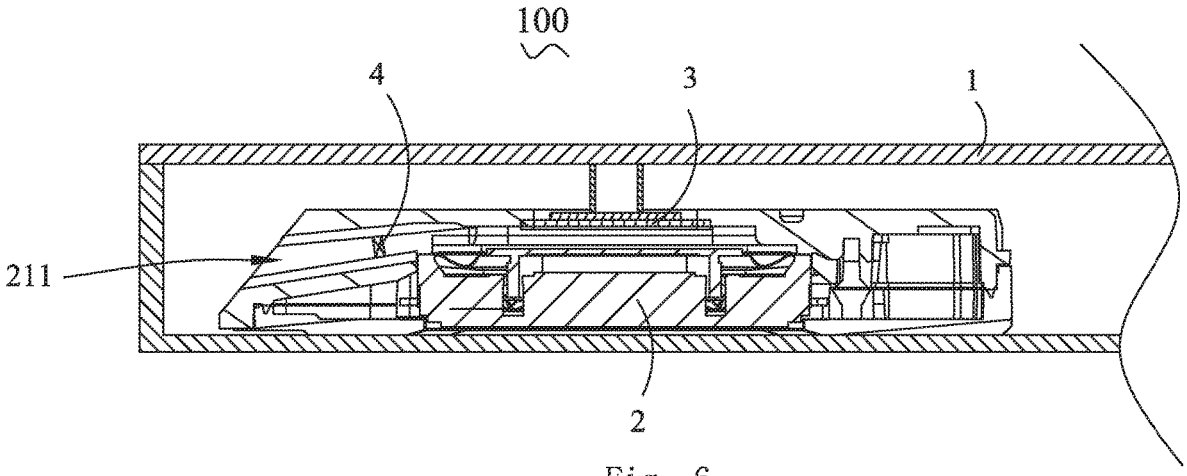
FIG. 6 is a cross-sectional view along a long axis direction of the sounding device of the invention.

Referring to FIG. 6 again, in the specific implement way of the invention, the one-way intake valve 3 comprises a flexible film 31 of which one end is fixedly arranged on the surface of one side, toward the diaphragm 221, of the cover plate part 212 and completely covers the through opening 2121, a reinforcement part 32 fixedly arranged on the flexible film 31, and an elastic body 33 of which one end is fixed on the reinforcement part 32 and the other end is fixed on the first housing body 1. The flexible film 31 comprises a fixation part 311 fixed to the cover plate part 212 and a free end part 312 capable of moving up and down relative to the cover plate part 212 to form an air inlet gap between the flexible film 31 and the cover plate part 212. The elastic body 33 is arranged close to the free end part 312. Through this design, the one-way intake valve 3 can only permit the air in the external environment to enter the front acoustic cavity 2101 and cannot discharge the air in the front acoustic cavity 2101 from the one-way intake valve 3.

The through opening 2121, the flexible film 31 and the reinforcement part 32 all are in a rectangular form, and the fixation part 311 and the free end part 312 are separately arranged at two ends of the flexible film 31 along a long axis direction thereof. In other embodiments, the shapes of the through opening 2121, the flexible film 31 and the reinforcement part 32 are not limited herein.

The elastic body 33 is in a hollow cylindrical form, one opening in one end thereof is fixed in the reinforcement part 32 and the other opening in the other end is formed in the inner side surface of the first housing body 1. When the diaphragm 221 does not vibrate up and down and is in a static state, the elastic body 33 is in a balanced state; when the diaphragm 221 vibrates downward, the air enters through the air inlet gap, and the elastic body 33 is in a tensile state and provides an upward drawing force to the diaphragm 221 at the moment; and when the diaphragm 221 vibrates upward, the air is discharged from the one-way air outlet valve 4, and the elastic body 33 provides a restoring force to the diaphragm 221 to rapidly close the one-way air outlet valve 4, so that the air in the front acoustic cavity 2101 is discharged only through the sound channel 211 and the air is prevented from entering the first accommodation space 10 again.

Figure 8:
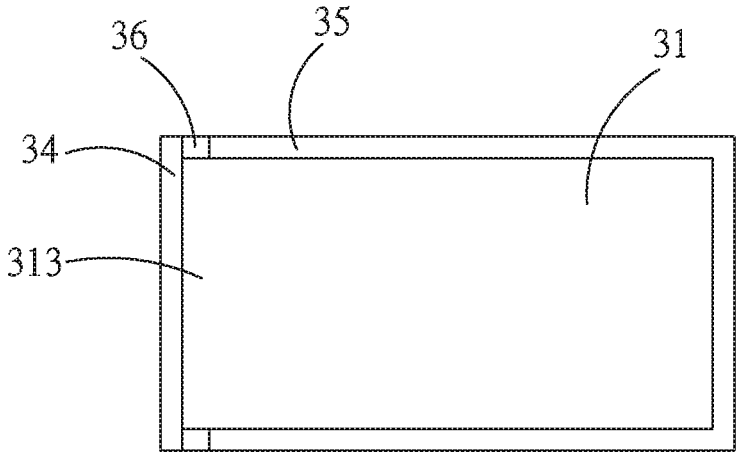
FIG. 8 is an illustration of the one-way intake valve.

It should further be noted that, the flexible film 31 further comprises a deformation part 313 connecting the free end part 312 and the fixation part 311. The deformation part 313 is positioned between the fixation part 311 and the cover plate part 212. Further referring to FIG. 8, the one-way intake valve 3 further comprises a reinforcement body 30 fixedly arranged on the circumference of the flexible film 31 and the surface of one side far away from the cover plate part 212. The reinforcement body 30 comprises spaced first reinforcement body 34 and second reinforcement bodies 35. The first reinforcement body 34 and the second reinforcement bodies 35 are spaced from one another to form an avoidance part 36. The avoidance part 36 corresponds to the deformation part 313. Through the arrangement of the deformation part 313, the deformability of the flexible film 31 can be improved and bending of the flexible film 31 can be achieved. In the embodiment, since the flexible film 31 is in a rectangular form, the fixation part 311 and the free end part 312 extend along a short axis direction of the flexible film 31. The first reinforcement body 34 is in an elongated form and is arranged corresponding to the fixation part 311. Three second reinforcement bodies 35 are arranged, each second reinforcement body 35 is arranged corresponding to the other three edges of the flexible film 31, and the three second reinforcement bodies 35 are arranged as a whole. Specifically, the first reinforcement body 34 and one second reinforcement body 35 extend along a short axis of the flexible film 31, and the other two second reinforcement bodies 35 extend along a long axis of the flexible film 31. The flexible film 31 and the cover plate part 212 are fixed in a bonding manner.

Specifically, the air in the external environment enters the first accommodation space 10 through the air inlet 11 and then enters the front acoustic cavity 2101 through the one-way intake valve 3; through vibration of the diaphragm 221, the air passes through the sound channel 211 and communicates with the through opening 2121 through the one-way air outlet valve 4; and the hot air outlet 12 communicates with the sound channel 211, thereby forming air circulation.

Certainly, the one-way air outlet valve 4 can also adopt a specific structure of the one-way air outlet valve 3, but the installation sequence is reversed, thereby ensuring that the air is discharged outside the speaker box 2 from the front acoustic cavity 2101.

The sounding device 100 further comprises a circuit board 5 used for arranging the speaker box 2.

Figure 7:
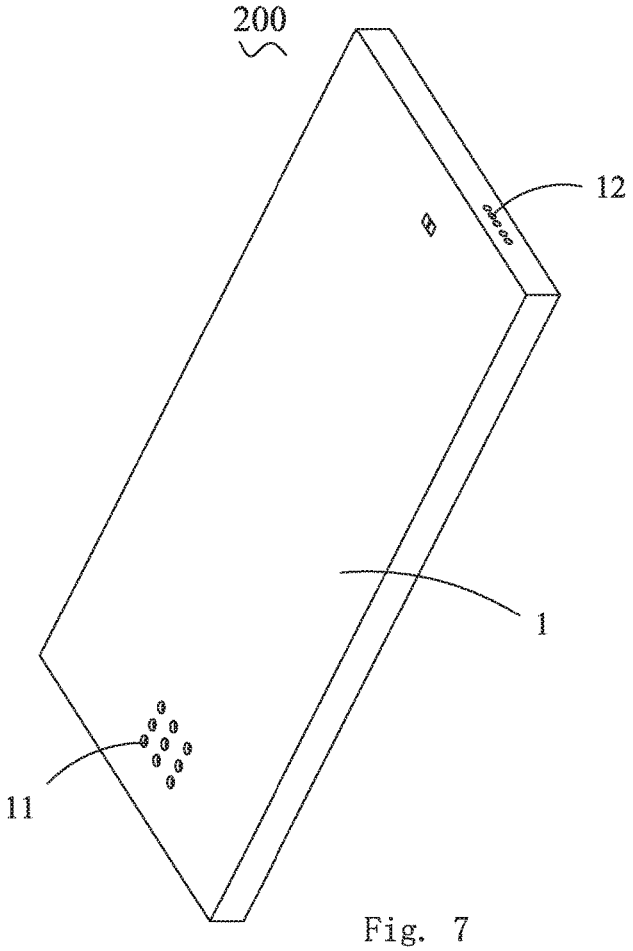
FIG. 7 is an isometric view of a mobile terminal of the embodiment of the invention.

Referring to FIG. 7 again, the invention further provides a mobile terminal 200, which comprises the sounding device 100. Specifically, the mobile terminal 200 may be a mobile phone, heat source components therein, such as a CPU and a battery generate heat, and air circulation inside the mobile terminal 200 is accelerated under the action of the sounding device 100, thereby achieving the effect of accelerating internal cooling.

The speaker box, serving as a fan in a mobile terminal, pushes air circulation inside and outside the mobile terminal, thereby achieving a heat dissipation effect and facilitating internal cooling of the mobile terminal.

The descriptions above are just preferred implement ways of the invention, it should be noted here that, for those of ordinary skill in the art, on the premise of keeping the creation and the conception of the invention, those of ordinary skill in the art can also make improvements, but all of which belong to the protection scope of the invention.

It is to be understood, however, that even though numerous characteristics and advantages of the present exemplary embodiments have been set forth in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms where the appended claims are expressed.

What is claimed is:

1. A sounding device, comprising:

a first housing body with a first accommodation space;

a speaker box accommodated in the first housing body, comprising a second housing body with a second accommodation space;

a speaker unit accommodated in the second housing body, comprising a diaphragm dividing the second accommodation space into a front acoustic cavity positioned between the diaphragm and the second housing body;

the second housing body comprising a sound channel communicating the front acoustic cavity and an external environment of the speaker box, and a cover plate part arranged directly opposite to the diaphragm;

the front acoustic cavity positioned between the diaphragm and the cover plate part;

the cover plate part comprising a through opening communicating the front acoustic cavity and the first accommodation space;

wherein the sounding device further includes a one-way intake valve arranged corresponding to the through opening for introducing air in the first accommodation space into the front acoustic cavity;

the one-way intake valve comprises a flexible film of which one end is fixedly arranged on the surface of one side, toward the diaphragm, of the cover plate part and completely covers the through opening, a reinforcement part fixedly arranged on the flexible film, and an elastic body of which one end is fixed on the reinforcement part and the other end is fixed on the first housing body;

the flexible film comprises a fixation part fixed to the cover plate part and a free end part capable of moving up and down relative to the cover plate part to form an air inlet gap between the flexible film and the cover plate part; and the elastic body is arranged close to the free end part.

2. The sounding device as described in claim 1, wherein the flexible film further comprises a deformation part connecting the free end part and the fixation part; the deformation part is positioned between the fixation part and the cover plate part; the one-way intake valve further comprises a reinforcement body fixedly arranged on the circumference of the flexible film and the surface of one side far away from the cover plate part; the reinforcement body comprises spaced first reinforcement body and second reinforcement bodies; the first reinforcement body and the second reinforcement bodies are spaced from one another to form an avoidance part; and the avoidance part corresponds to the deformation part.

3. The sounding device as described in claim 2, wherein the flexible film is spaced from the cover plate part.

4. The sounding device as described in claim 2, wherein the flexible film is in a rectangular form; and the fixation part and the free end part extend along a short axis direction of the flexible film.

5. The sounding device as described in claim 4, wherein the first reinforcement body is in an elongated form and is arranged corresponding to the fixation part; three second reinforcement bodies are arranged; each second reinforcement body is arranged corresponding to the other three edges of the flexible film; and the three second reinforcement bodies are formed as a whole.

6. The sounding device as described in claim 1, wherein the flexible film is spaced from the cover plate part.

7. The sounding device as described in claim 1, wherein the elastic body is in a hollow cylindrical form.

8. The sounding device as described in claim 7, wherein the through opening and the reinforcement part both are in a rectangular form matched with the shape of the flexible film.

9. The sounding device as described in claim 8, further comprising a one-way air outlet valve arranged in the sound channel, wherein the one-way air outlet valve is used for discharging the air in the front acoustic cavity into the external environment of the speaker box through the sound channel.

10. The sounding device as described in claim 9, wherein the first housing body comprises an air inlet communicating the external environment and the first accommodation space, and an air outlet communicating with the sound channel; the one-way intake valve connects the first accommodation space and the front acoustic cavity; and the one-way air outlet valve connects the sound channel and the air outlet.

11. The sounding device as described in claim 1, wherein the through opening and the reinforcement part both are in a rectangular form matched with the shape of the flexible film.

12. The sounding device as described in claim 11, further comprising a one-way air outlet valve arranged in the sound channel, wherein the one-way air outlet valve is used for discharging the air in the front acoustic cavity into the external environment of the speaker box through the sound channel.

13. The sounding device as described in claim 12, wherein the first housing body comprises an air inlet communicating the external environment and the first accommodation space, and an air outlet communicating with the sound channel; the one-way intake valve connects the first accommodation space and the front acoustic cavity; and the one-way air outlet valve connects the sound channel and the air outlet.

14. A mobile terminal, comprising a sounding device as described in claim 1.

* * * * *